US011097930B2

(12) United States Patent
Fiorese

(10) Patent No.: US 11,097,930 B2
(45) Date of Patent: Aug. 24, 2021

(54) APPARATUS FOR THE REPARATION OF POST-COLLISION, DAMAGED OR UNDER MAINTENANCE VEHICLES

(71) Applicant: Francesco Fiorese, Padua (IT)

(72) Inventor: Francesco Fiorese, Padua (IT)

( * ) Notice: Subject to any disclaimer, the term of this patent is extended or adjusted under 35 U.S.C. 154(b) by 289 days.

(21) Appl. No.: 16/330,870

(22) PCT Filed: Sep. 5, 2017

(86) PCT No.: PCT/EP2017/072218
§ 371 (c)(1),
(2) Date: Mar. 6, 2019

(87) PCT Pub. No.: WO2018/046487
PCT Pub. Date: Mar. 15, 2018

(65) Prior Publication Data

US 2019/0185300 A1 Jun. 20, 2019

(30) Foreign Application Priority Data

Sep. 7, 2016 (IT) ..... 102016000090667

(51) Int. Cl.
*B66F 7/28* (2006.01)
*B21D 1/14* (2006.01)
*B66F 7/10* (2006.01)

(52) U.S. Cl.
CPC ..... *B66F 7/28* (2013.01); *B21D 1/14* (2013.01); *B66F 7/10* (2013.01)

(58) Field of Classification Search
CPC ..... B21D 1/12; B21D 1/14; B66F 7/10; B66F 7/28; B66F 7/08; B66F 5/02
See application file for complete search history.

(56) References Cited

U.S. PATENT DOCUMENTS 3,835,692 A * 9/1974 Hoffman ..... B21D 1/14 72/442
4,546,638 A * 10/1985 Field ..... B21D 1/14 72/455

(Continued)

FOREIGN PATENT DOCUMENTS

FR 2752538 2/1998

OTHER PUBLICATIONS

International Search Report of PCT/EP2017/072218, dated Nov. 22, 2017.

*Primary Examiner* — Lee D Wilson
*Assistant Examiner* — Seahee Hong
(74) *Attorney, Agent, or Firm* — Collard & Roe, P.C.

(57) ABSTRACT

There is provided an apparatus for the repair of post-collision or damaged vehicles or those under maintenance, which includes a lifter (1) having an upper platform (2) supported by a lifting mechanism (3) connected to a resting base (4) mounted on the ground. The lifter (1) is activated by an actuator (5) which adjusts the upper platform (2) to the desired height. Wheel resting/gripping supports (6) for the vehicle are removably fixed to the upper platform and allow the vehicle to be lifted and lowered by the lifter. Pushing and/or pulling and/or anchoring equipments (7) for the vehicle are movably mounted on a sliding element (8) which is adapted to be slideably mounted within the structure of the wheel resting/gripping supports thereby allowing the quick mounting and centering of the pushing/pulling/anchoring equipments (7) to the desired points of the vehicle under repair.

13 Claims, 14 Drawing Sheets

(56) References Cited

U.S. PATENT DOCUMENTS

| | | | | | |
|---|---|---|---|---|---|
| 4,574,614 | A * | 3/1986 | Field | B21D 1/14 | 187/211 |
| 4,984,657 | A * | 1/1991 | Burns | B66F 7/025 | 187/207 |
| 5,339,926 | A * | 8/1994 | McCanse | B66F 7/04 | 187/204 |
| 2004/0061100 | A1 * | 4/2004 | Keaton | B66F 7/0691 | 254/90 |
| 2005/0279153 | A1 * | 12/2005 | Venalainen | B21D 1/12 | 72/457 |

* cited by examiner

APPARATUS FOR THE REPARATION OF POST-COLLISION, DAMAGED OR UNDER MAINTENANCE VEHICLES

CROSS REFERENCE TO RELATED APPLICATIONS

This application is the National Stage of PCT/EP2017/072218 filed on Sep. 5, 2017, which claims priority under 35 U.S.C. § 119 of Italian Application No. 102016000090667 filed on Sep. 7, 2016, the disclosures of which are incorporated by reference. The international application under PCT article 21(2) was published in English.

BACKGROUND OF THE INVENTION

1. Field of the Invention

The present invention relates to an apparatus for the reparation of post-collision, damaged or under maintenance vehicles, according to the general portion of claim 1.

2. Description of the Related Art

As is well known for the reparation of the body, the housing and the frames of the post-collision vehicles are used the so-called large counters, where for counter is meant an assembly composed of a platform/framework on which are applied pushing and/or pulling and anchoring equipment of the vehicle, which are part of the same. Said large counters have large dimensions and often have a platform/framework having the dimensions which have a length and width equal to or higher to the vehicles being repaired; they can be rested on the floor or on the upper part of the structure of a lifter, which allows the counter itself to be raised at different heights. In the large counters the vehicle is raised with the wheel resting directly on the platform/framework or on the platforms/structures suitable to support the wheels, fixed to the structure of the platform/framework, or to other components of the counter itself. The platform/framework of the large counters is not only of large dimensions, but even structurally sturdy, because on it are fixed the clamps and the supports required to keep the vehicle anchored (fixed integrally) to the platform/framework of the large counter when the pulling arms are used for tensioning and rectifying the body and/or the frame of the post-collision vehicle.

Often a large counter is replaced by smaller and more compact counters, because presently most large repairs, which were made in the past on the large counters, due to the ever growing costs of the spare parts of the vehicle body and the mechanical type and to the diffusion of the expensive electronic spare parts such as airbags and other devices, are no longer suitable for which is more economical avoiding the repair and demolishing the vehicle.

For this reason the majority of current reparations on damaged vehicles, which are of slight extent, must be of reduced cost and rapid, for which the equipment used must be adequate for the requirements of the reparation and thus have small dimensions and low costs.

However also the small counters turn out to be in many cases too expensive, both on account of the purchase cost and of the working times on reparations of modest extent. The small compact counter is generally constituted at the top by a platform/framework that must be sufficiently sturdy to allow the fixing and the use of at least a pulling arm and at the same time also the fixing of the clamps for anchoring the damaged vehicle. The small counters are connected to various types of lifters, for example scissors, parallelogram or other lifting system to allow to lift the vehicle at the desired working height. In small counters the vehicle is raised by small pads made of rubber, which rest in lower lifting points indicated by the manufacturer of the vehicle and are supported by supports fixed removably or fixed to the platform/framework. In other cases the vehicle is raised with the wheels resting on independent supports, fixed to the platform/framework. In these cases the vehicle lifting with the wheels bearing on the supports is more suitable in reparations of the body, because the vehicle body does not undergo bending. When the vehicle is raised by underbody by means of the rubber pads, the vehicle body is subjected to bending due to the weight of the motor and the mechanical parts. For all these reasons the small counters have a platform/framework of more compact dimensions with respect to the vehicle to repair and consequently the platform/framework itself must be a sturdy construction, since the position both of the pulling arm and of the anchoring arms of the clamps, obviously constrained by the dimensions of the vehicle, cause very high stresses that the pulling system transmits to the platform/framework of the counter. Moreover, due to the existing distances between the platform/framework of the small counter and the exterior of the vehicle to the position of the pulling arm with respect to the support attachment of the arm itself and to the position of the clamps with respect to their mounting support on the platform/framework of the counter, the structures of the pulling arm, of the supporting arms and of the clamps must be particularly strong and heavy. At present, it is possible therefore to identify four types of reparations, of which three on lifting counter and one with the vehicle on the ground without counter and lifting unit:

1. on large counter: high and medium cost reparations of vehicles severely damaged in an accident, where it is convenient to carry out the intervention (low percentage);
2. on small counter: reparations of averagely damaged vehicles (average percentage);
3. on small counter: reparations of slightly damaged vehicles, in which the operation is time consuming related to purchasing costs of the apparatus and to the time of use of the same (medium-high percentage);

4 without counter: reparations of vehicles which have small damages on the outer parts, which are usually carried out with the vehicle to the ground and without lifting unit (high percentage).

In cases 1 and 2 the straightening operations are carried out on a specific area of the body; subsequently the vehicle is moved in other areas for carrying out the remaining operations with consequent waste of time.

In case 3, the ratio of convenience between the apparatus cost and the extent of the intervention is economically disadvantageous, so that would be suitable to facilitate a high percentage of reparations with an appropriate equipment in order to obtain reduced purchase costs of the equipment, rapid processing times and the possibility of use it for ordinary maintenance and reparation works.

In the case 4 a part of very frequent reparations relates to small dents in the external bodywork and underdoor of the vehicle, for the reparation of which are used manual traction equipment like screw or lever, that are uncomfortable and fatigue because they are cumbersome, require the use of both hands and, when small pulling arms rested on the ground are used, they oblige the operator to take up awkward positions when must intervene on the lower parts of the vehicle. When the dents are located in underdoor of the vehicle and in the lower more robust parts of the structure, caused by contact with the pavements or by unevenness in the road surface, the operations are very awkward and fatigue.

The most important document of the prior art is FR 2752538 A1, which describes a device that exactly corresponds to the object of the general portion of claim 1.

It is also worth mentioning the following additional document: US 2005/279153 A1.

SUMMARY OF THE INVENTION

Object of the present invention is to provide an apparatus for the reparation of post-collision, damaged or under maintenance vehicles, that does not have the drawbacks suffered by similar known devices.

The new apparatus object of the present invention provides the use of a lifter, equipped with an upper platform/framework to which are detachably fixed the wheel resting/gripping supports, so that the vehicle is raised and lowered with the wheel resting on the wheel resting/gripping supports.

In particular the novelty consists in the application to the structure of wheel resting/gripping supports of pushing and/or pulling and/or anchoring equipment of the vehicle, which include at least one pulling arm and/or other devices or pushing and/or pulling elements, for example jacks and/or anchoring vises and/or other devices or anchoring elements for the secure fixing of the body or of the mechanical elements of the vehicle. Moreover, the novelty also consists in placing the elements of the pulling and/or anchoring equipment and the pushing and/or pulling arm, vises and supports, next to the anchoring and/or fixing points of the vehicle, so that the same elements constituting the pulling and/or anchoring equipment, the pushing and/or pulling arm and the vises and/or supports of pulling and/or anchoring, present reduced dimensions and they are lightweight, in such a way as to be easily handled and manually applied. The presence of a horizontal element which can slide inside the structure of the wheel resting/gripping supports, to which are fixed the pushing and/or pulling and/or anchoring equipment, allows rapid application and centering of the equipment and anchoring of the vehicle to repair.

The wheel resting/gripping supports are independent and in the form of a plate, the vehicle wheels being capable of being blocked or to slightly move. The shape of resting/gripping supports can be made in such a way as to block the wheels of the vehicle, or may present a different form. The wheel resting/gripping supports can be mutually connected by means of additional elements, beyond the connecting elements to the platform/framework.

It is clear that in this way the use of the invention leads to a considerable advantage in terms of economic saving, due to the fact that it does not make necessary the purchase of expensive equipment, as well as in ergonomic terms for the operators, because the processing time is reduced and the operations are much less fatigue.

The new apparatus according to the invention is particularly advantageous when it is necessary to intervene on the occasion of lateral and inferior small damages to the underdoor of the vehicle because, being the vehicle supported by wheel resting/gripping supports, the front and rear lower parts, and in particular the lateral underdoor of the vehicle are obstacles free, allowing the operator to easily intervene in the more adequate lifting height, thanks to the use of new pushing and/or pulling and/or anchoring equipment.

The possibility of being able to adjust the length and/or the width of the wheel resting/gripping supports, combined with the reduced dimensions thereof, allows to leave free most of the lower part of the vehicle and to obtain that the structures of the used pulling and/or anchoring equipment are much lighter thanks to the small distances between the vehicle and the anchoring areas on the wheel resting/gripping supports. Furthermore the feature of having the anchoring vises of the vehicle applied to a horizontal element which can slide inside the structure of the wheel resting/gripping supports, allows to compensate, in certain conditions, the torsional effect of the force applied to the wheel resting/gripping supports due to the weight of the vehicle and to absorb part of the force that the pushing and/or pulling arm exerts on the wheel resting/gripping supports. Also the horizontal element moving inside the structure of the wheel resting/gripping supports is an integral part of the pushing and/or pulling and/or anchoring equipment, can remain at rest inside the wheel resting/gripping supports itself and for this reason the pushing and/or pulling and/or anchoring equipment parts are less fatigue for the operator to handle and can be very light.

The new apparatus according to the invention allows to solve the drawbacks due to manual screw or lever equipment and to the pulling arms rested on the ground, because the light pushing and/or pulling arm is easily fixed to the lifting wheel resting/gripping supports raised to the more comfortable height. The use of the invention in underdoor reparations enables a faster and more comfortable work, thanks to the possibility of using the deviation roller also in the lower part of the horizontal pulling arm, which is open along the longitudinal axis. The deviation roller, adjusted to different heights, allows to obtain the correct direction of the chain, which is connected to the end point to be repaired and at the other end to the vertical element of the arm, that tensions the chain itself by means of a jack, while in the central part of the horizontal element of the pulling arm the chain is diverted by deviation roller before reaching the ends.

The form of the pushing and/or pulling arm, constituted by a vertical element and a horizontal element, both distinguished by a series of through holes, allows to carry out most of traction works. When pushing operations are necessary, these are easily performed thanks to the presence of the holes made on the horizontal element of the pulling arm which allow the vertical element to be hinged in a pair of the holes present along the horizontal element of the arm, leaving the possibility of hinging the jack on the outer part of the horizontal portion of the pulling arm, using one of the pairs of holes present. In this way the activation of the jack causes the push of the vertical portion of the arm toward the vehicle thus creating a thrust action. The deviation roller can be adjusted on the horizontal arm in the vertical direction by means of the hole present on the body of the support roller, by using the same pin with which the vertical and horizontal adjustments of the roller itself are performed.

It is to be understood that it is possible to obtain different working configurations depending on the combination of the various elements of the system which can be put together. The presence of the holes on the horizontal part of the arm, the use on the occurrence of extensions of the vertical arm with the element of square section, which slides inside the wheel resting/gripping support, the presence of conjunction elements, also with a square shape, allows the possibility of inclination of the pushing and/or pulling arm to 90° or 180°, thereby allowing to perform operations both of pulling and pushing in the inner and/or lower parts of the vehicle, in parts of the vehicle corresponding to the size of the wheel resting/gripping supports, in the area of the mudguards. This possibility is allowed by virtue of the fact that the pushing and/or pulling arm apply to the vehicle traction forces out of axis with respect to the axis of insertion of the horizontal portion of the pulling arm directly in the sliding element. The sliding element can also support other accessories, such as for example a support with jack to raise the vehicle, in order to release the wheel from the wheel resting/gripping support during the normal routine maintenance of a vehicle.

BRIEF DESCRIPTION OF THE DRAWINGS

Further advantages and characteristics of the present invention will be better defined by means of the description of a possible embodiment thereof, given only as a non-limiting example, with the aid of the enclosed drawing tables wherein.

DETAILED DESCRIPTION OF THE PREFERRED EMBODIMENTS

Figure 1:
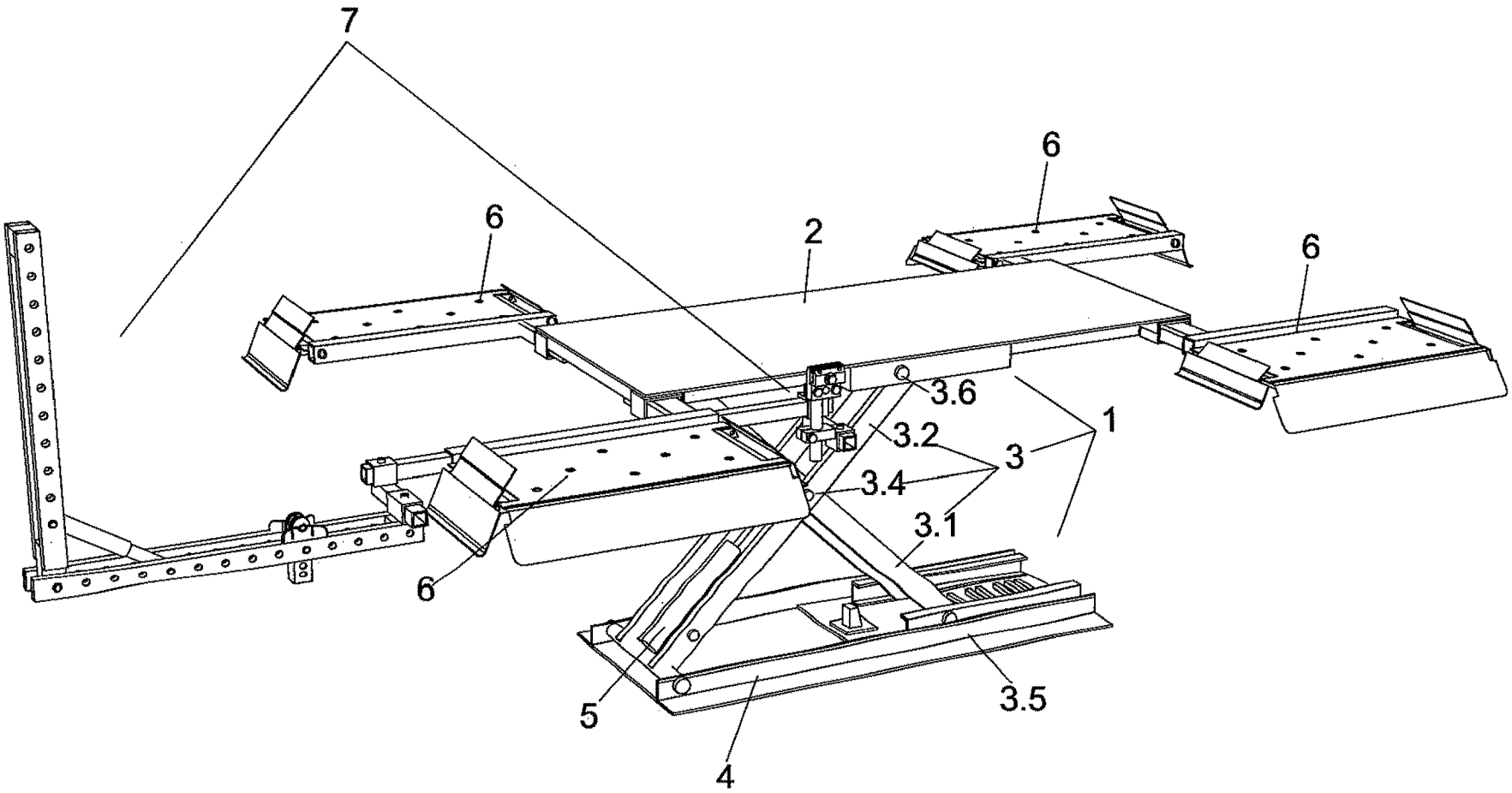
FIG. 1 represents a perspective view of the apparatus for the reparation of damaged vehicles, according to the invention.

In FIG. 1 is visible the equipment for the reparation of damaged vehicles according to the invention comprising the four wheel resting/gripping supports 6 fixed in a removable way to the platform/framework 2 of a lifter 1, on one of said supports being fixed pushing and/or pulling and/or anchoring equipments 7, in which the lifting/lowering movement of the upper platform/framework 2 is obtained by means of a lifting mechanism 3, which comprises, in correspondence of each of the two longitudinal sides of said upper platform/framework 2, two pairs of levers 3.1 and 3.2, mutually articulated in an intermediate section 3.4; the two parallel levers 3.2, more outer, are provided with the upper end of casters 3.6 sliding inside the upper platform/framework 2 and the lower end is hinged with a pin to the base 4, while the two parallel levers 3.1, arranged inside, are provided with the upper end of hinges, positioned at the inside of the upper structure of the upper platform/framework 2, while they are provided at the end of lower casters 3.5 sliding at the ground level along a concordant trajectory with the longitudinal axis of the resting base 4.

The entire lifting mechanism is actuated by a hydraulic or pneumatic actuator, indicated with reference numeral 5, which has the lower end articulated on the pair of levers 3.2, arranged more externally, while the upper end acts on the pair of levers 3.1, placed more internally.

Also in FIG. 1 are visible four wheel resting/gripping supports 6 which are inserted in a removable way on the same supports arranged on the structure placed on top of the platform/framework 2 of the lifter.

Figure 2:
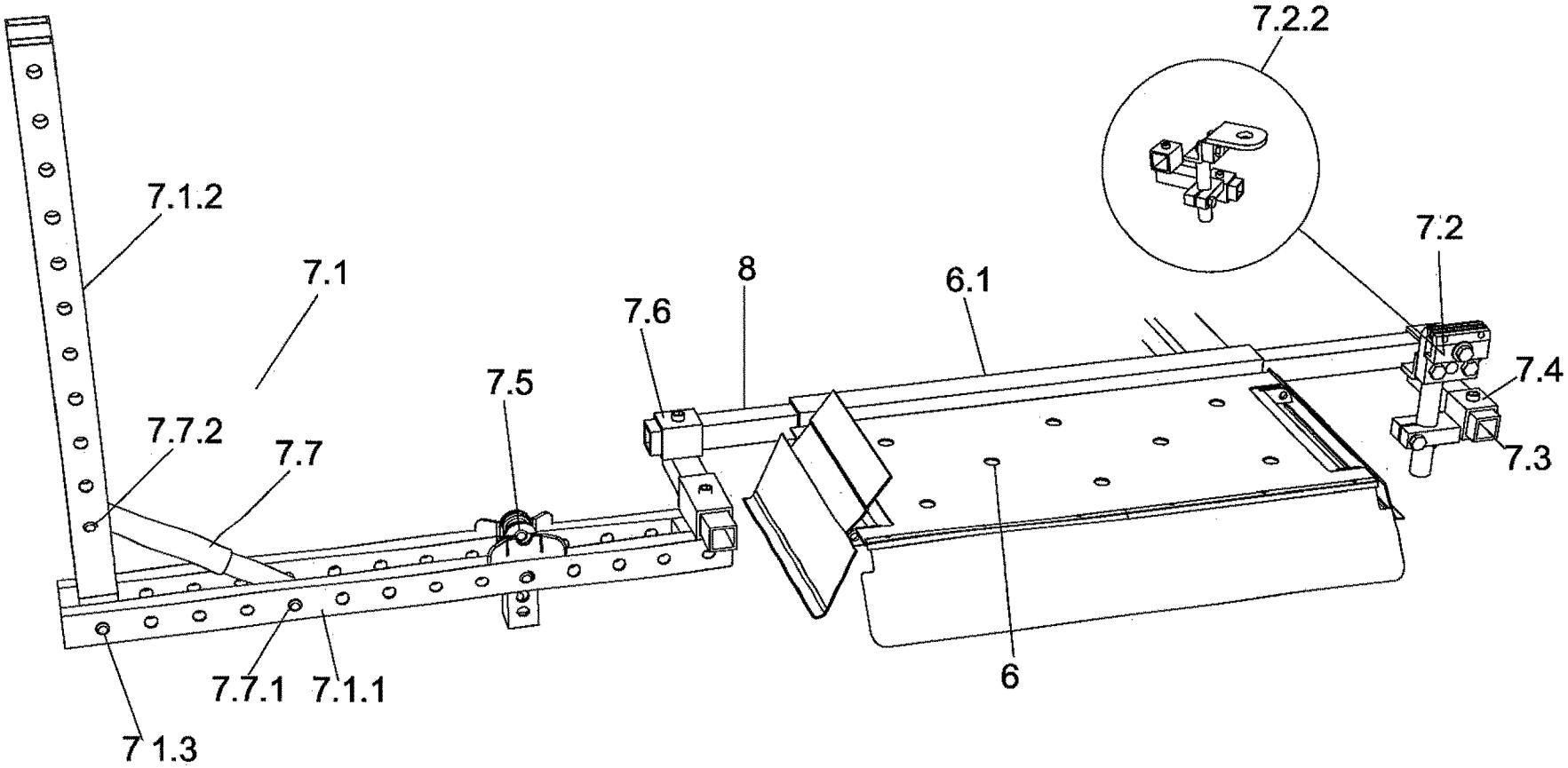
FIG. 2 represents a perspective view of the apparatus for the reparation of damaged vehicles with an application of a pushing and/or pulling arm and an anchoring vise, fixed on the horizontal element sliding inside the wheel resting/gripping support.
Figures 3, 4:
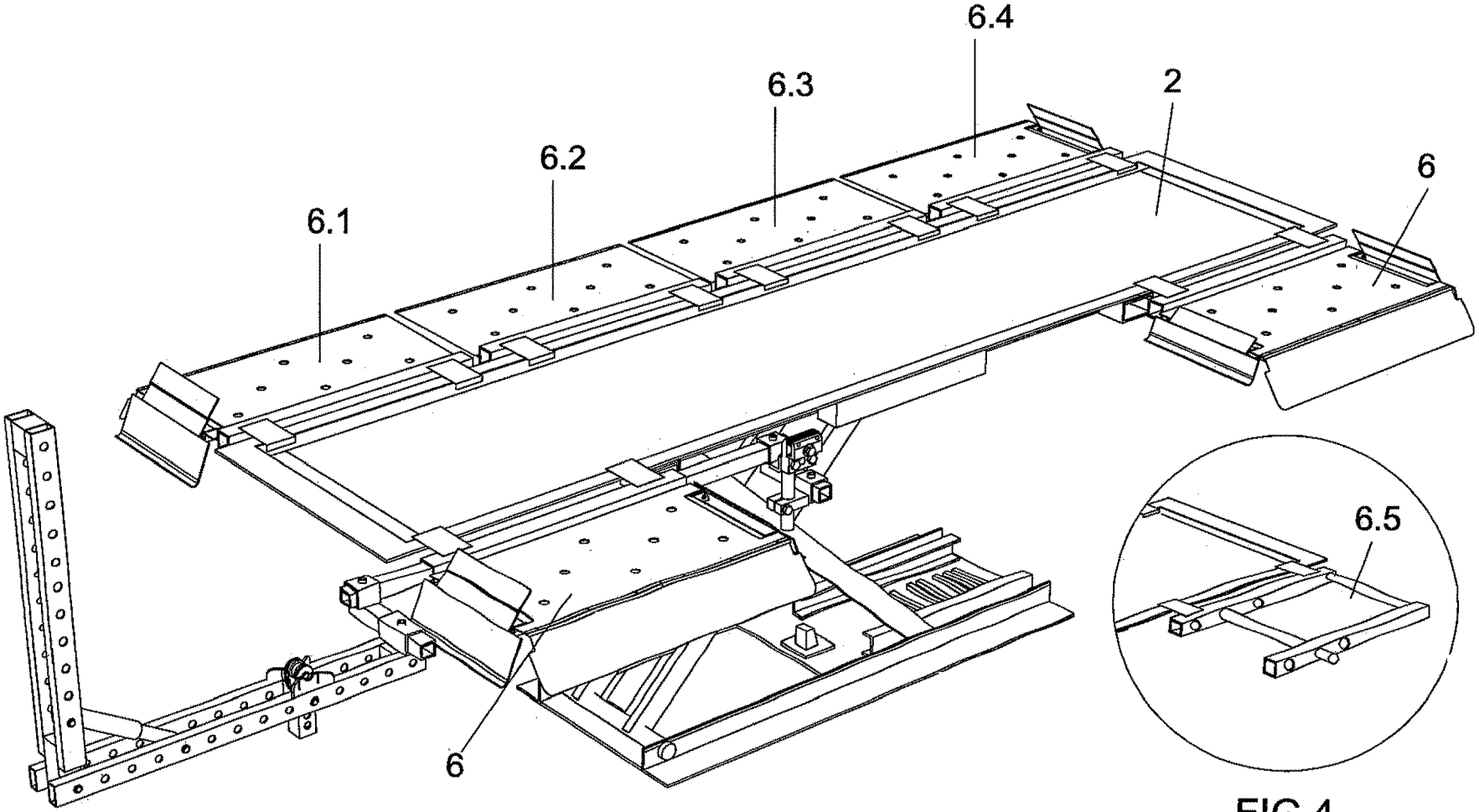
FIG. 3 represents a perspective view of the apparatus for the reparation of damaged vehicles with a typical application of the wheel resting/gripping support arranged aligned with each other on the platform/framework.
FIG. 4 represents a perspective view of the apparatus for the reparation of damaged vehicles with a particular embodiment of the wheel resting/gripping support in the form of a frame on the platform/framework.
Figure 5:
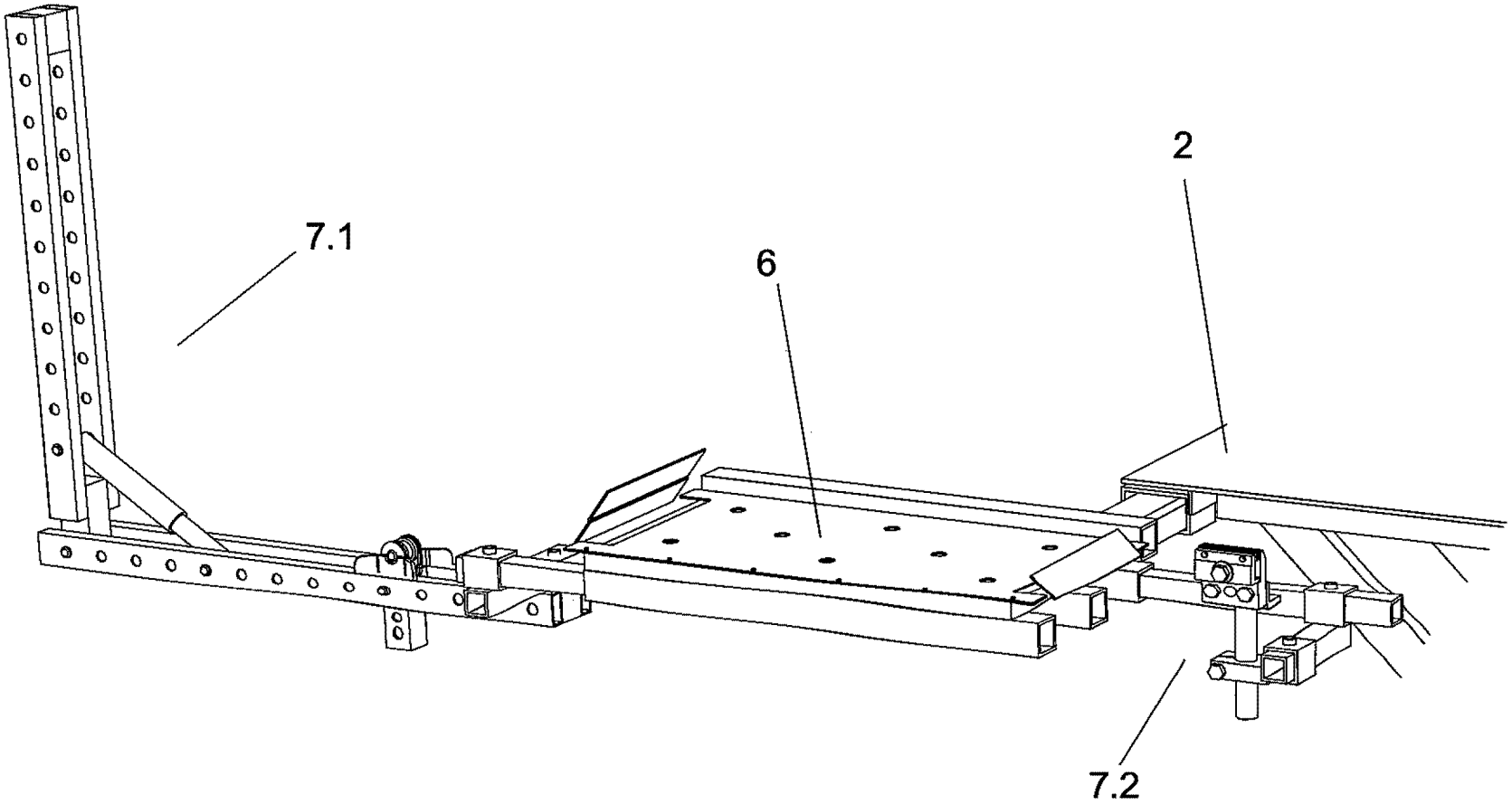
FIG. 5 represents a perspective view of the apparatus for the reparation of damaged vehicles with a particular application of the pushing and/or pulling equipment and of the anchoring vises on the wheel resting/gripping support.
Figure 6:
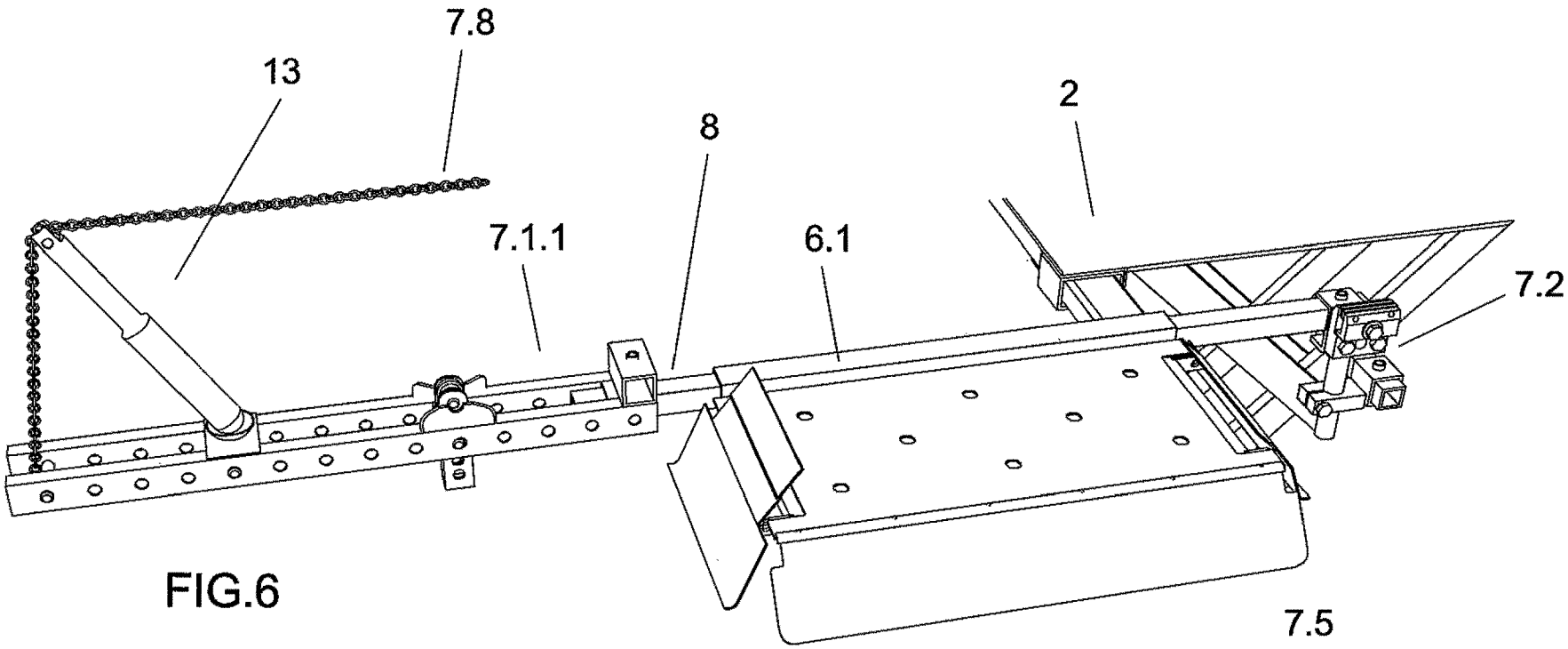
FIG. 6 represents a perspective view of the apparatus for the reparation of damaged vehicles, with a special application of a pushing and/or pulling jack on the horizontal part of the pushing and/or pulling equipment in which the horizontal part is directly fixed to the sliding element, without the use of the support shown in FIG. 2.
Figure 7:
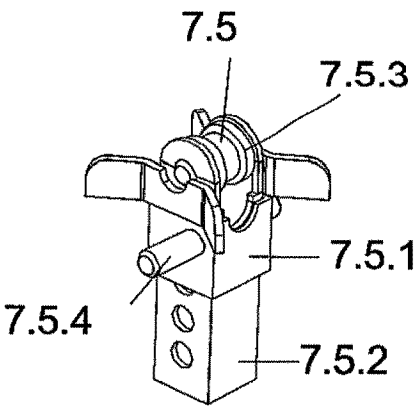
FIG. 7 shows a perspective view of the deviation roller applied to telescopic element, sliding inside a support, applied in turn to the horizontal element of pushing and/or pulling arm by means of the pin.
Figure 8:
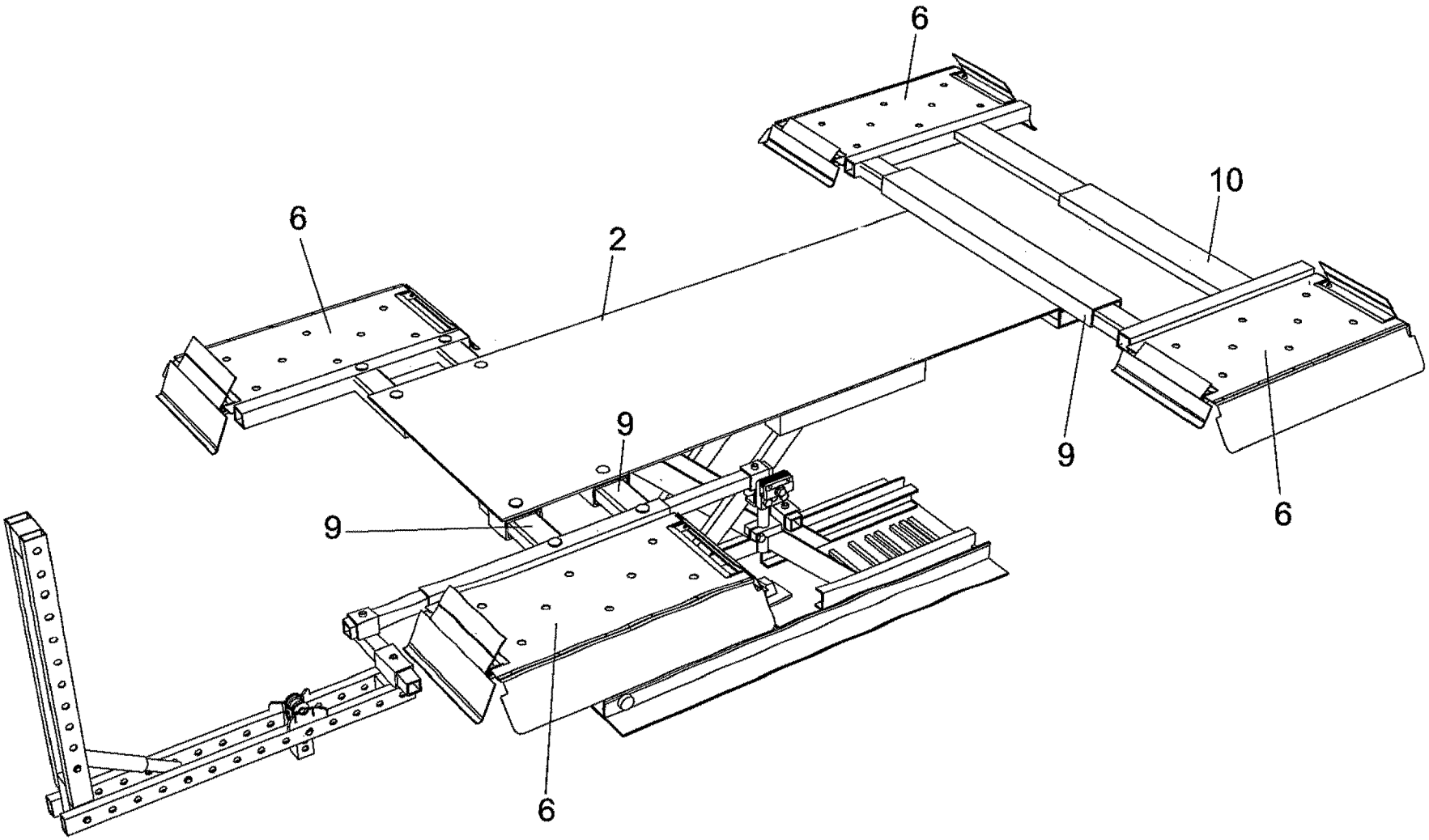
FIG. 8 relates to some different elements for connecting the wheel resting/gripping support to the upper platform/framework and the possible connection elements fixed or removable supports between the same wheel resting/gripping supports.

In FIG. 2 is shown a structure of the wheel resting/gripping support 6 which provides, together with other parts, a tubular structure 6.1, preferably having a square cross section, inside which is housed a sliding element 8, which has also a squared section. The sliding element 8 has a greater longitudinal dimension than the tubular 6.1 of the structure of the wheel resting/gripping support 6, in such a way as to be able to project from both sides; in this manner on its inner side can be fixed the anchoring vise 7.2 by means of a fixing support realized in order to maintain the vehicle anchored, while on the opposite side can be fixed the pushing and/or pulling arm 7.1 by means of the support 7.6, or directly on the sliding element 8 by means of a receptacle formed inside the horizontal structure 7.1.1 of the pushing and/or pulling arm 7.1. In practice, the sliding element 8 which can be moved inside the tubular 6.1 of the wheel resting/gripping support 6, is more easily adapted to the different lengths of the vehicles to repair since it has the possibility of being displaced in both directions, toward the inside and the outside, with respect to the longitudinal axis of the upper platform/framework 2 and is blocked at the ends of the external tubular 6.1 by means of screws with rapid fixing.

The anchoring and/or fixing vises 7.2 is provided with a pin and is connected to the sliding element 8 by means of a support 7.4, which is locked by means of a fixing clamp, realized in such a way as to allow the adjustment of the clamp in a vertical direction and which moves perpendicularly with respect to the sliding element 8, being fixed on the support 7.3, sliding parallel to the longitudinal axis of the sliding element 8. In practice this system allows to perform rapidly the centering of the vise 7.2, being able to move with three degrees of freedom and precisely, longitudinal axis x-x, thanks to the support 7.3, and perpendicular axis z-z and vertical y-y, thanks to the support 7.4, thus allowing a quick centering of the vise 7.2 with respect to the anchoring points of the vehicle.

Always in FIG. 2 is visible the pushing and/or pulling arm 7.1, which is embedded and fixed to the sliding element 8 by means of the support 7.6 so as to allow the adjustment of the pushing and/or pulling arm 7.1 both in a longitudinal and in a transversal direction with respect to the upper platform/framework 2.

The pushing and/or pulling arm 7.1 is realized in two pieces, one horizontal 7.1.1 and the other 7.1.2 orientable in the vertical level and hinged to the horizontal one by the pin 7.1.3, using one of the pairs of holes formed on the horizontal element 7.1.1. The horizontal element 7.1.1 of the pushing and/or pulling arm 7.1 is provided with a central opening, which allows the attachment of a group 7.5, composed of a deviation roller 7.5.3, a support 7.5.1 inside which slides a tubular element 7.5.2, to which is hinged the roller 7.5.3 by means of a pin. The inner tubular element 7.5.2 is provided with a series of holes to allow the adjustment of deviation roller 7.5.3 at different heights by means of the pin 7.5.4, which at the same time anchor the support 7.5.1, the sliding support 7.5.2 to the horizontal element 7.1.1 of the pushing and/or pulling arm 7.1, allowing in this way the adjustment of the deviation roller 7.5.3 both along the longitudinal and vertical axis, with respect to the horizontal element 7.1.1 pushing and/or pulling arm 7.1.

Figure 9:
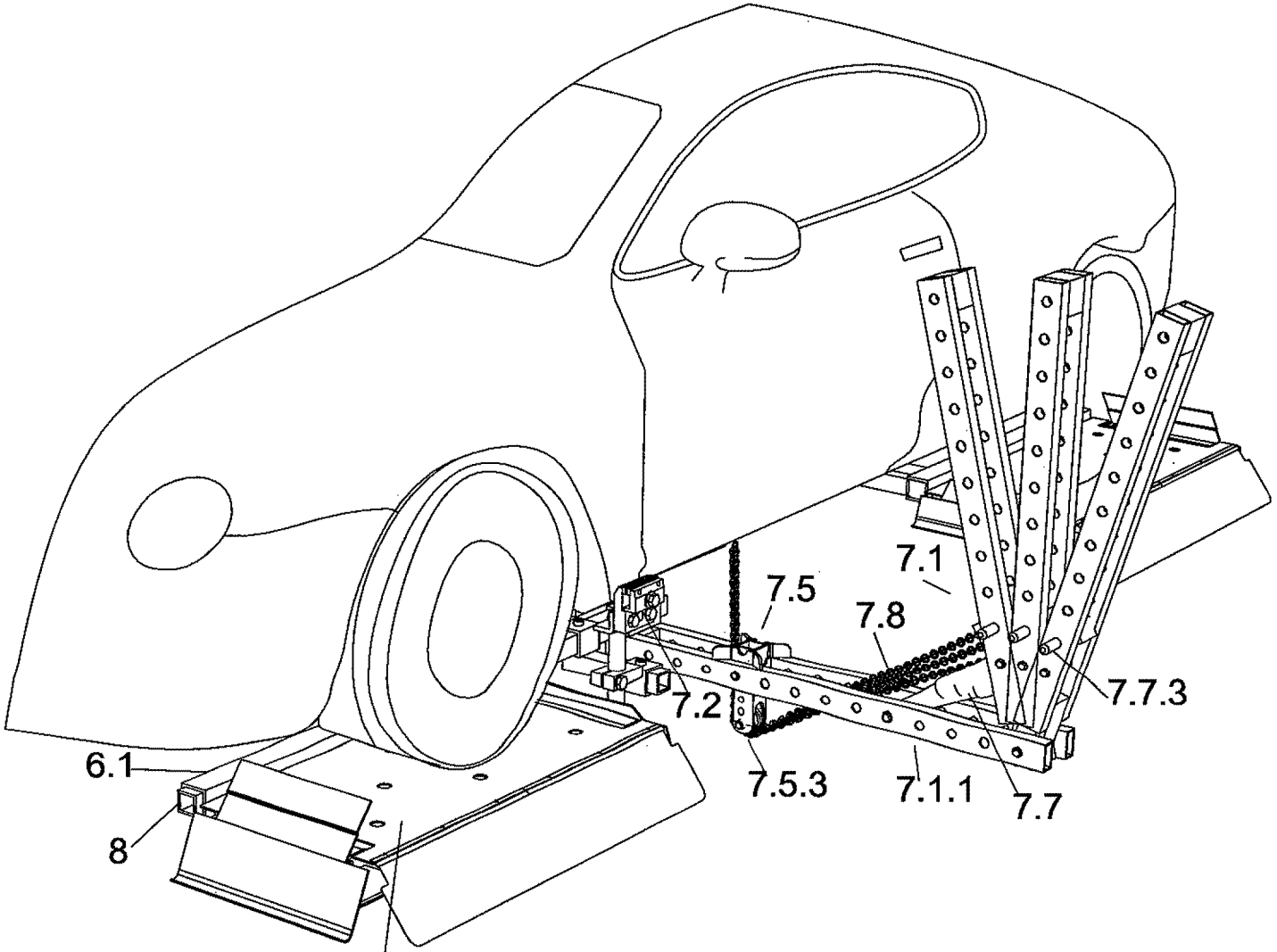
FIG. 9 relates to the deviation roller assembly applied to the lower part of the pushing and/or pulling arm, in which it is shown the central longitudinal opening of the horizontal element, crossed by a chain that, deviated by the roller, is pivoted at one of the holes of the vertical element of pushing and/or pulling arm by means of a pin; in this figure the vertical element of the pulling arm is represented in three different positions, while also shows the vise fixed in the same side to the sliding element, which projects out of the inner side of the wheel resting/gripping support.
Figure 10:
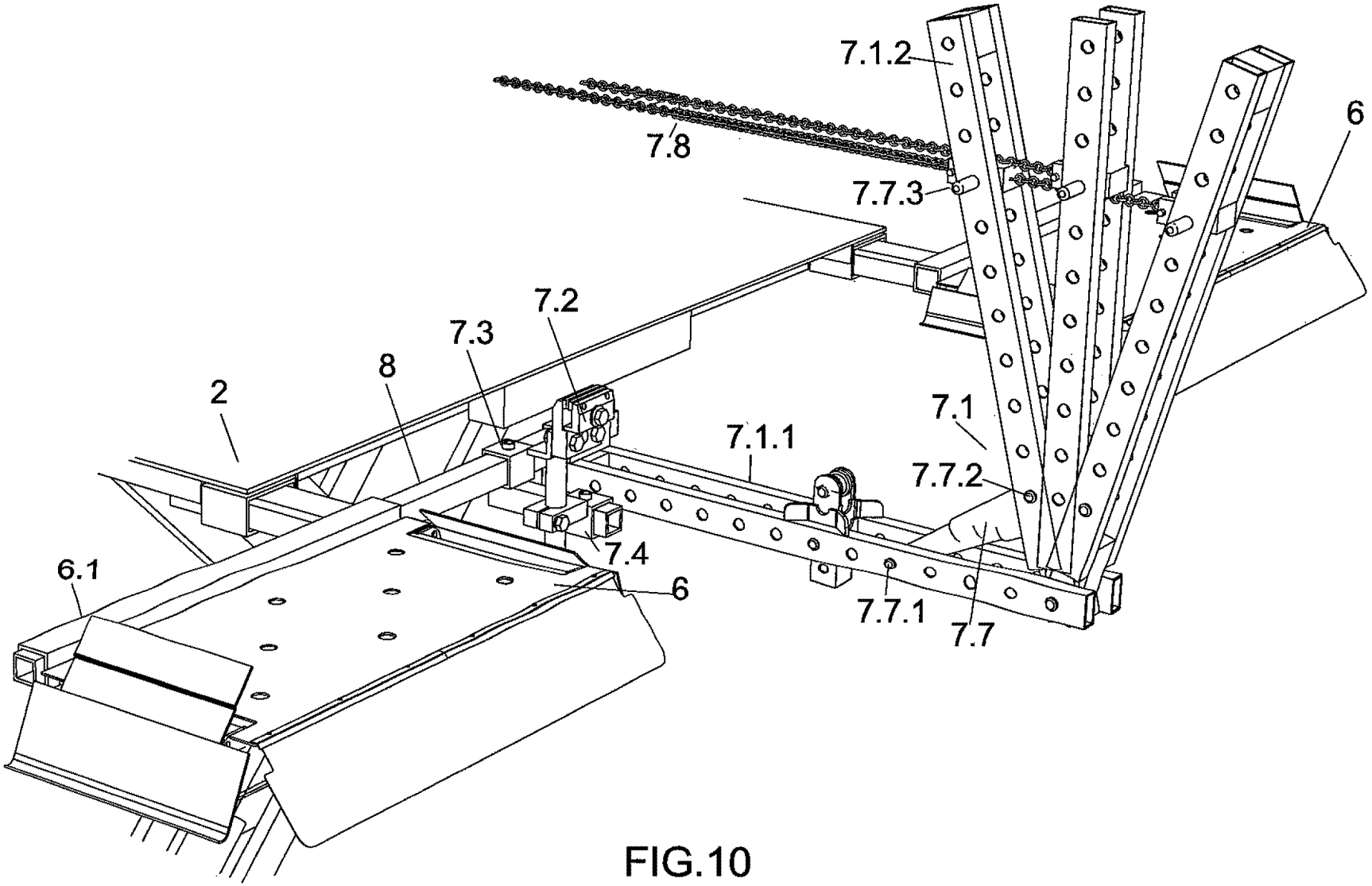
FIG. 10 relates to the fixing of pushing and/or pulling equipment and/or anchoring in sliding element which projects out of the inner side of the wheel resting/gripping support, in a direct traction step.
Figure 11:
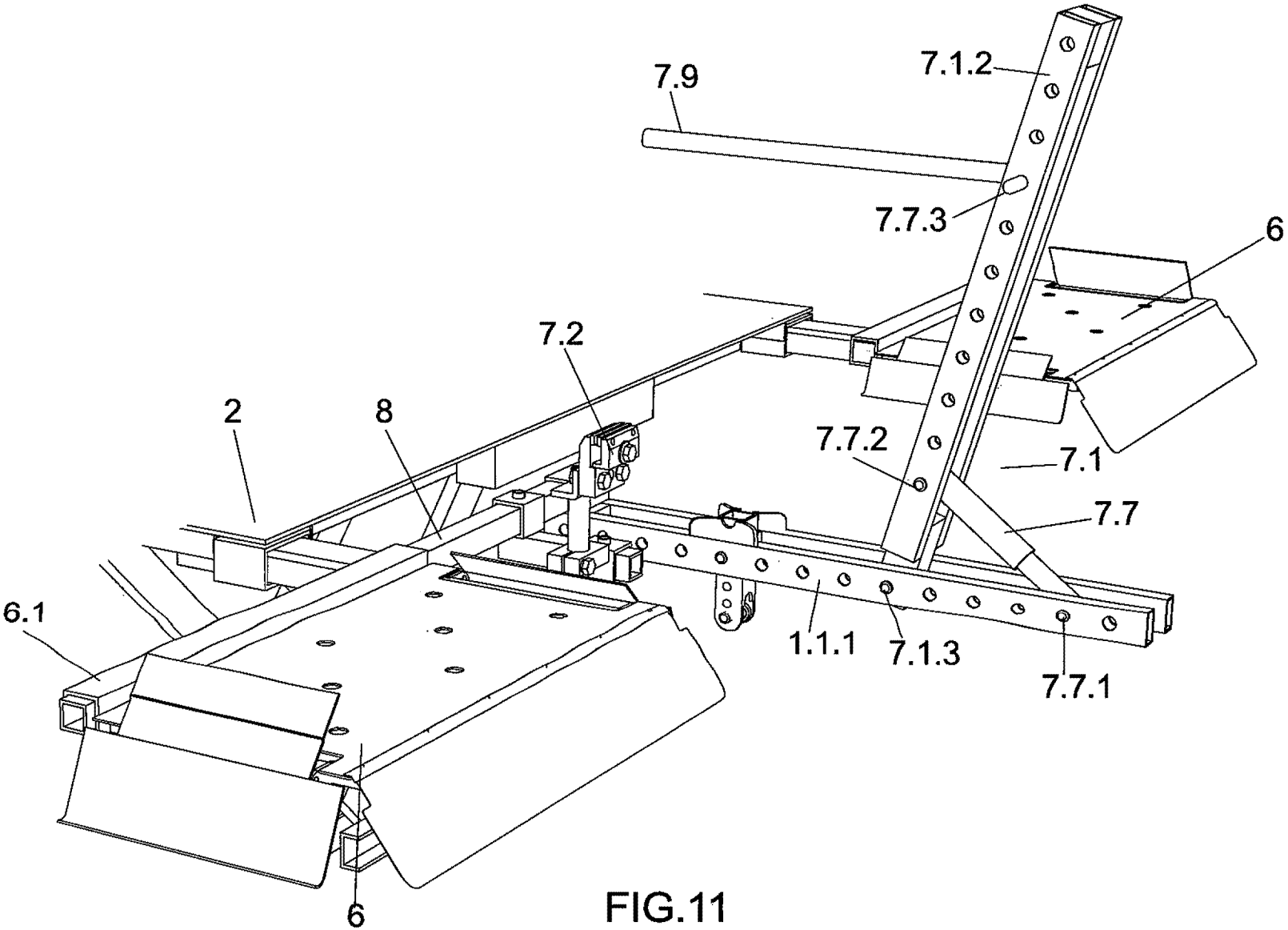
FIG. 11 relates to the pushing and/or pulling arm in a pushing configuration, in which the vertical element is hinged to the horizontal element in a middle hole, while the jack is pivoted in the vertical element by means of the pin and in the horizontal element by means of the pin, so as to obtain, by means of the jack, a pair of traction forces which tend to move the vertical element away from the horizontal member, allowing to exert a compressive force on a region of the vehicle by means of a rigid element.
Figure 12:
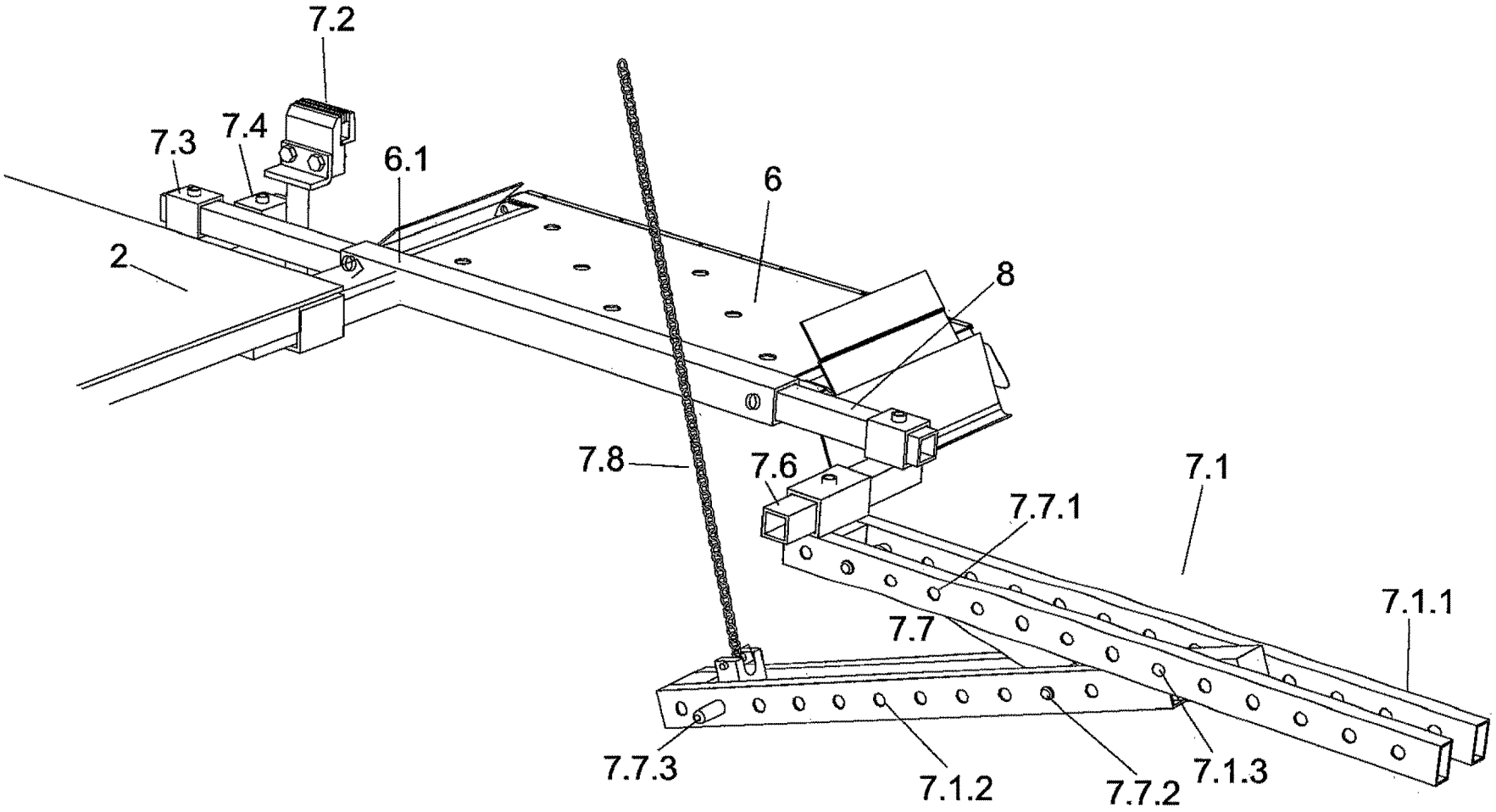
FIG. 12 shows the horizontal element of pushing and/or pulling arm with the application of the vertical element in the lower part, by means of hinging on a pin located in a middle hole of the horizontal element, so as to allow to intervene in the lower internal parts of the vehicle.
Figure 13:
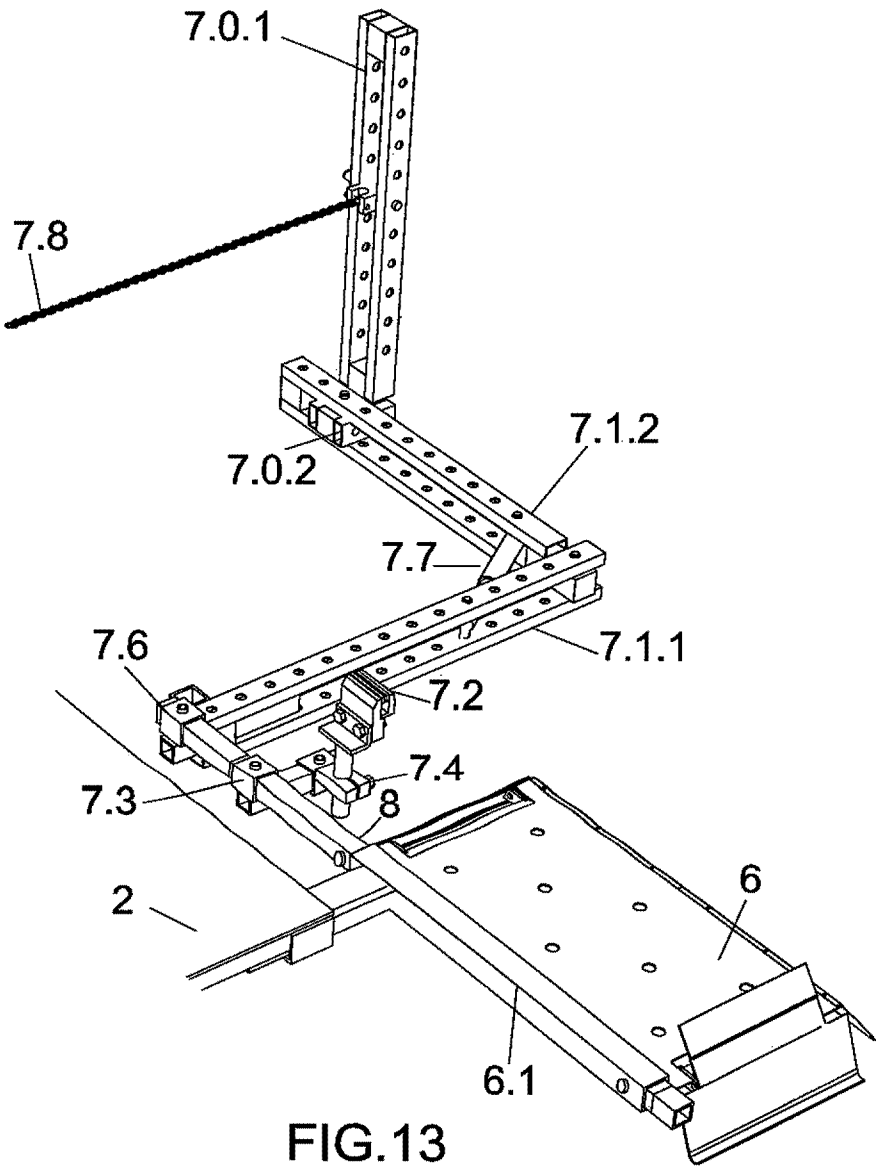
FIG. 13 shows the pushing and/or pulling arm mounted in a horizontal position with the horizontal and vertical elements mutually positioned with a mutually variable angle (90° in the figure) in order to be able to intervene in the central zone of the vehicle; said figure shows two accessory elements, constituted by a vertical element, applied to a vertical element by means of an adapter support.
Figure 14:
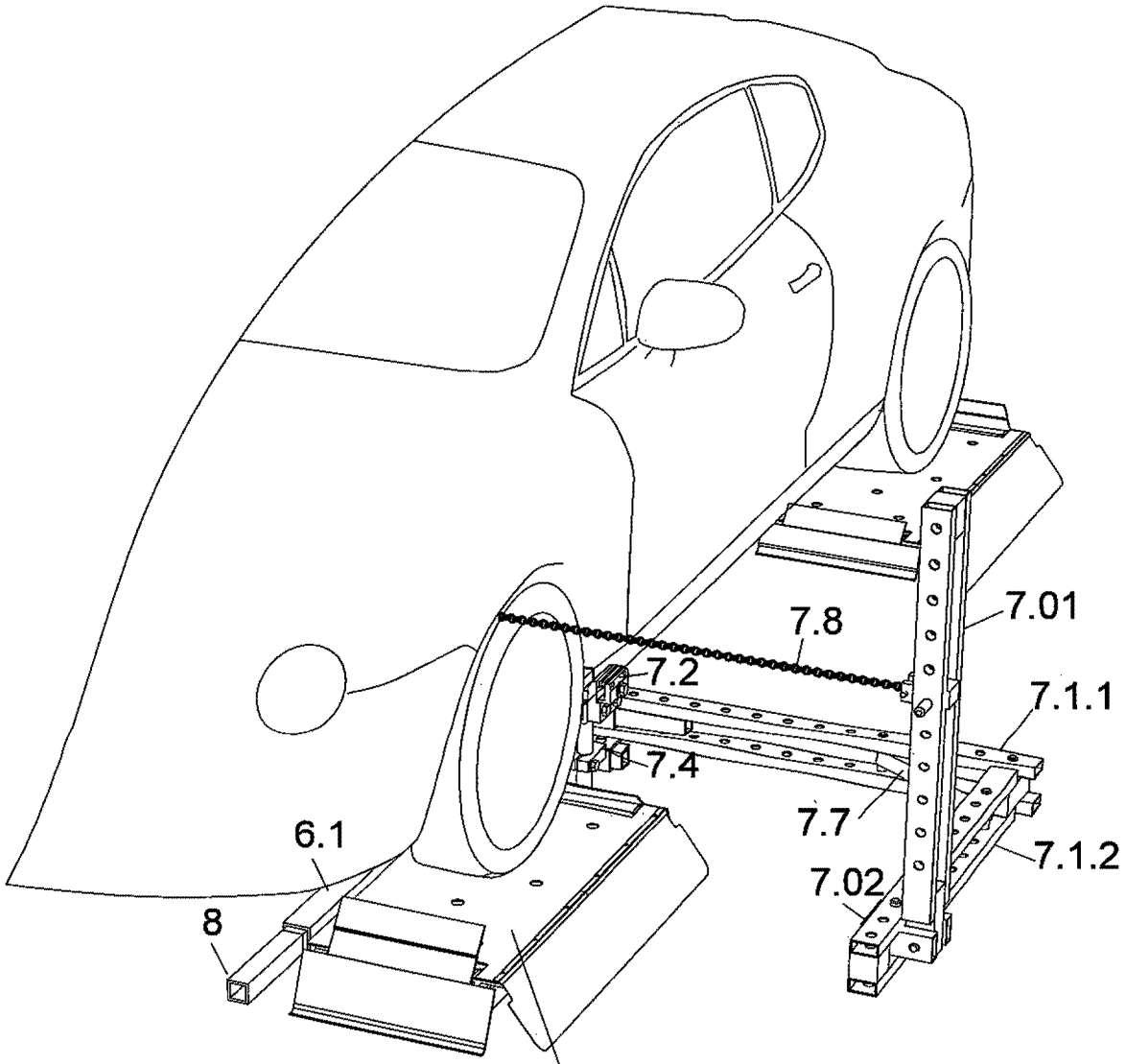
FIG. 14 shows the pushing and/or pulling arm mounted in a horizontal position with the horizontal and vertical elements mutually positioned with a variable angle (90° in the figure) in order to be able to intervene in the position occupied by the wheel resting/gripping support; said figure shows two accessory elements, constituted by a vertical element, applied to a vertical element by means of an adapter support.
Figure 15:
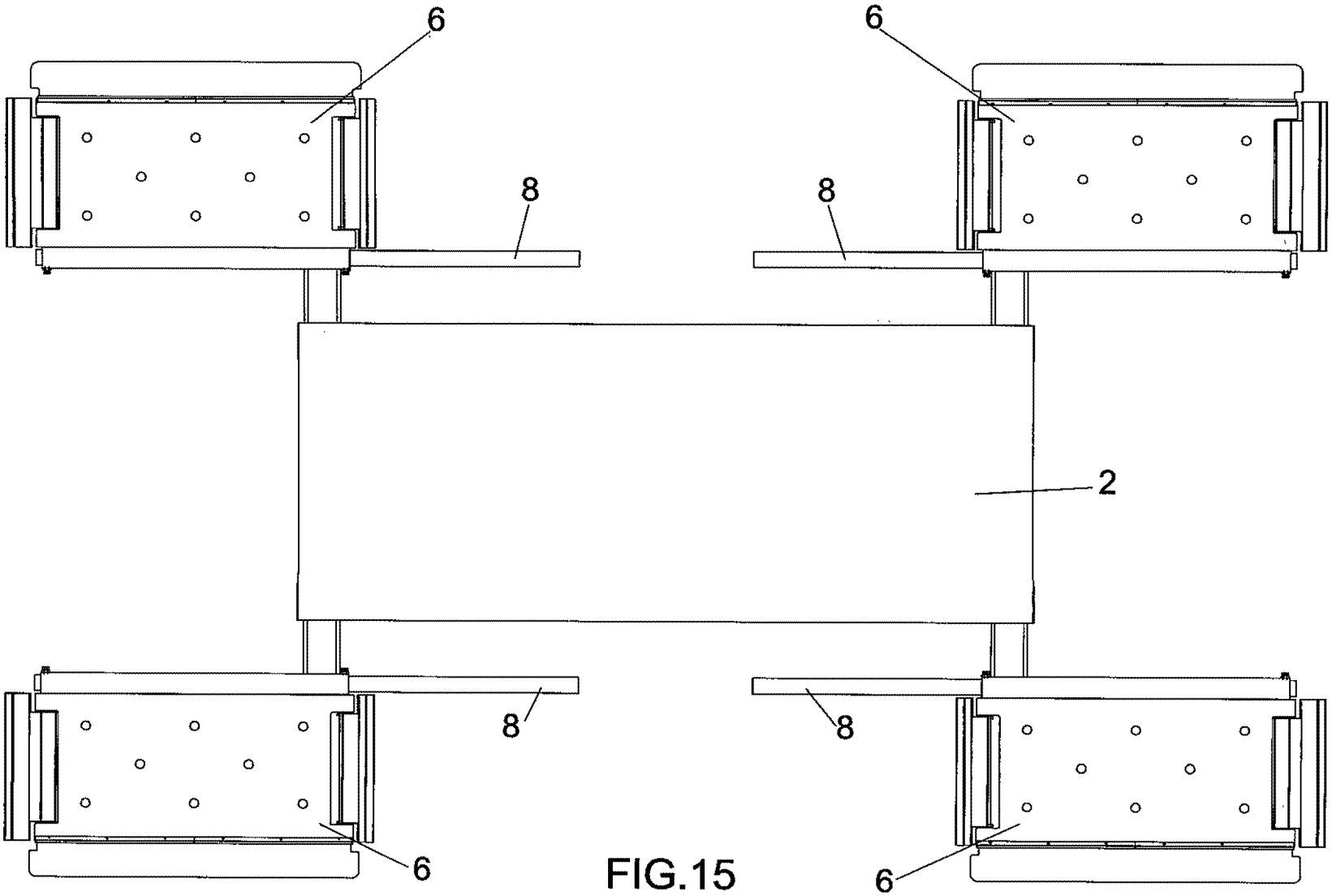
FIG. 15 shows a plan view of the lifter lowered with the four wheel resting/gripping supports removably secured to the platform/framework, each with the sliding element mounted inside the wheel resting/gripping support.
Figure 16:
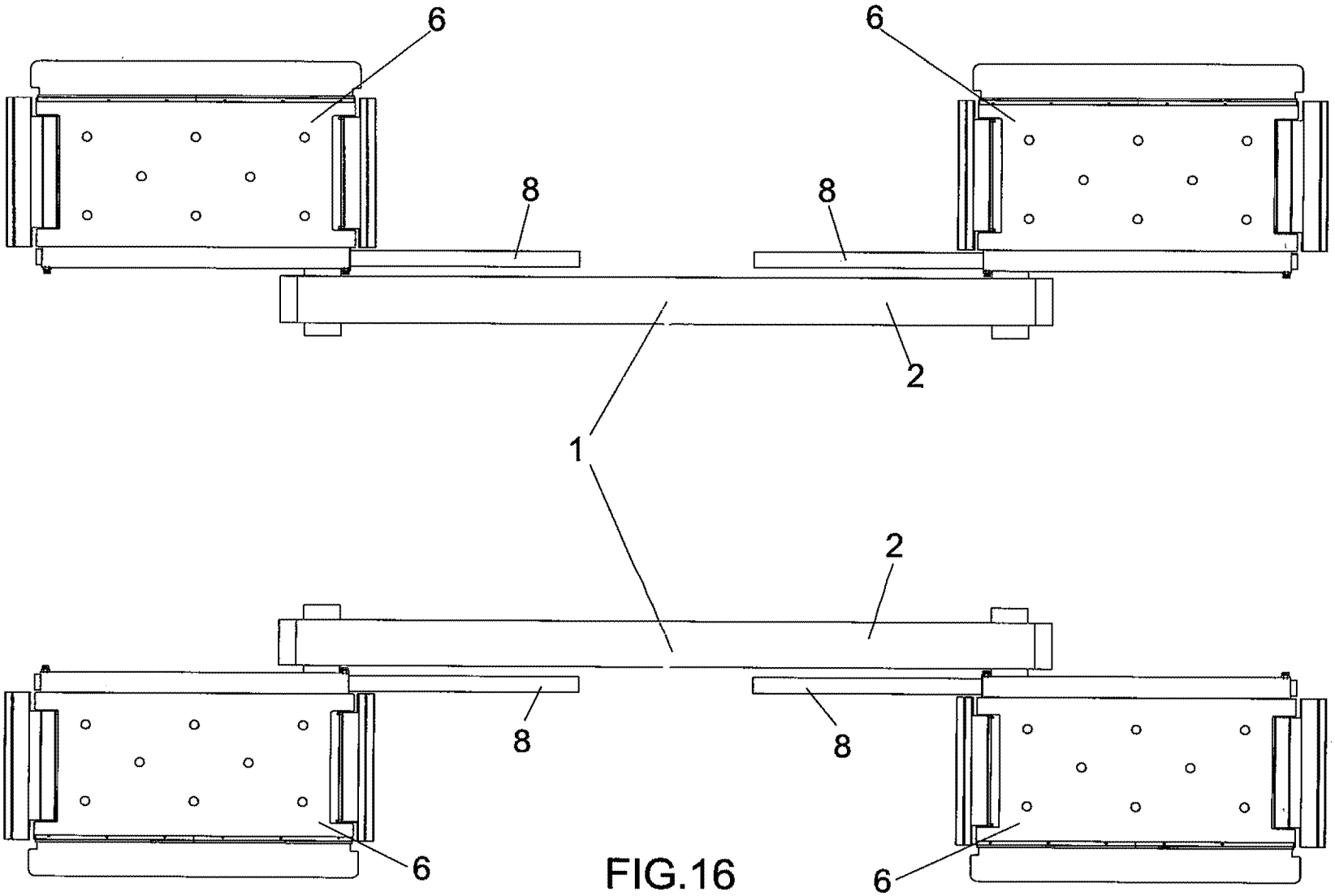
FIG. 16 shows a plan view of a lowered lifter of the type with double lifting independent structure, which can be with embedded cylinders or scissors levers or parallelogram shape of various embodiment, in which the central part between the two structures has no impediment and leave free space in order to allow access to the lower part of the vehicle. In this configuration the platform/framework is necessarily divided into two independent parts.

The longitudinal opening of the horizontal element 7.1.1 of the pushing and/or pulling arm 7.1 allows to position the deviation roller 7.5.3 both upward and downward in order to allow to perform the pull on the body of the vehicle downward, as shown in FIG. 9. The deviation roller 7.5.3, adjusted to different heights, allows to obtain the correct direction of the chain 7.8, which is connected to the end point to be repaired and at the other end to the vertical element of the arm 7.1, that tensions the chain 7.8 itself by means of a jack 13, while in the central part of the horizontal element 7.1.1 of the pulling arm 7.1 the chain 7.8 is diverted by deviation roller 7.5.3 before reaching the ends.

The invention claimed is:

1. An apparatus for the repair of a post-collision or damaged vehicle or vehicle under maintenance, said apparatus comprising:

a lifter including an upper platform or framework, a lifting mechanism for lifting and lowering said upper platform or framework, a base connected to and supporting said lifting mechanism, an actuator for actuating said lifting mechanism so as to position said upper platform or framework at a desired height, and a plurality of wheel resting/gripping supports each movably mounted to said upper platform or framework and supporting a wheel of the vehicle mounted on said apparatus, said plurality of wheel resting/gripping supports being adapted to lift and lower said vehicle together with the lifting and lowering of said upper platform or framework;

pushing or pulling or anchoring equipments for said vehicle including a pushing or pulling arm, an anchoring vise, an anchoring support, wherein said pushing or pulling or anchoring equipments are mounted on a sliding element mounted for sliding movement on said wheel resting/gripping supports thereby permitting the mounting and centering of the pushing or pulling or anchoring equipments at desired points of said vehicle.

2. The apparatus as defined in claim 1, wherein said sliding element extends in a longitudinal direction from at least one side of said wheel resting/gripping supports.

3. The apparatus as defined in claim 1, wherein said sliding element mounted for sliding movement on said wheel resting/gripping supports has a length greater than that of said wheel resting/gripping supports so that said sliding element can extend from both sides of said wheel resting/gripping supports in correspondence of vehicle fixing and repair points.

4. The apparatus as defined in claim 1, wherein said pushing or pulling or anchoring equipments can be mounted in any position of the wheel resting/gripping supports.

5. The apparatus as defined in claim 1, wherein said wheel resting/gripping supports are removably mounted to said upper platform or framework.

6. The apparatus as defined in claim 1, wherein the wheel resting/gripping supports oppositely mounted to said upper platform or framework are movably interconnected by telescoping elements.

7. The apparatus as defined in claim 1, wherein said wheel resting/gripping supports are movably mounted to said upper platform or framework through connecting elements formed integrally with said upper platform or framework.

8. The apparatus as defined in claim 1, wherein said wheel resting/gripping supports comprise a plurality of individual supports arranged in alignment and movably mounted to said upper platform or framework.

9. The apparatus as defined in claim 1, further comprising a deviation roller group, wherein the pushing or pulling arm includes a horizontal element and a connected vertically orientable element, said horizontal element being longitudinally open so as to be configured to receive therein a flexible pulling element to effect pulls on the mounted vehicle using the deviation roller group.

10. The apparatus as defined in claim 9, wherein said deviation roller group includes a deviation roller fixedly mounted on a telescoping support adapted to slide in a jacket, said telescoping support including a vertically arranged series of holes, said jacket including a hole, wherein said horizontal element includes longitudinally arranged holes, a pin adapted to fix together said telescoping support, said jacket, and said horizontal element.

11. The apparatus as defined in claim 1, wherein said wheel resting/gripping supports are each formed of a single plate supporting the wheel of the mounted vehicle so that the wheel is movable.

12. The apparatus as defined in claim 11, wherein the single plate is configured to support the wheel of the mounted vehicle in a locked position on said single plate.

13. The apparatus as defined in claim 1, wherein said wheel resting/gripping supports are each formed having a framework-shape so as to fit the wheel of the mounted vehicle.

* * * * *